US008146317B1

(12) United States Patent
Fletcher et al.

(10) Patent No.: US 8,146,317 B1
(45) Date of Patent: Apr. 3, 2012

(54) EDGE ATTACHMENT FOR PORTABLE GROUND FLOORING SYSTEMS

(75) Inventors: G. Shane Fletcher, Winchester, VA (US); Edward Bindon, Fairfax, VA (US)

(73) Assignee: Ground Floor Systems, LLC, Winchester, VA (US)

( * ) Notice: Subject to any disclaimer, the term of this patent is extended or adjusted under 35 U.S.C. 154(b) by 0 days.

(21) Appl. No.: 13/247,644

(22) Filed: Sep. 28, 2011

(51) Int. Cl.
*E04B 5/00* (2006.01)

(52) U.S. Cl. ..... 52/582.2; 52/582.1; 52/588.1; 52/592.1; 52/604

(58) Field of Classification Search ..... 52/69–71, 52/177, 220.4, 582.1, 582.2, 586.1, 586.2, 52/588.1, 589.1, 590.2, 590.3, 592.1, 604, 52/698; 404/34–41, 47–49; 403/252–255, 403/292–295; 428/58, 60
See application file for complete search history.

(56) References Cited

U.S. PATENT DOCUMENTS

| | | | | |
|---|---|---|---|---|
| 3,235,040 | A * | 2/1966 | Ellis | 52/794.1 |
| 3,614,915 | A * | 10/1971 | Perry | 404/40 |
| 3,859,000 | A * | 1/1975 | Webster | 404/41 |
| 5,185,193 | A * | 2/1993 | Phenicie et al. | 428/57 |
| 5,313,751 | A * | 5/1994 | Wittler | 52/238.1 |
| 6,324,796 | B1 * | 12/2001 | Heath | 52/177 |
| 7,090,430 | B1 * | 8/2006 | Fletcher et al. | 404/35 |
| 7,364,383 | B2 * | 4/2008 | Fletcher et al. | 404/35 |
| 7,500,713 | B2 * | 3/2009 | Riley et al. | 296/191 |
| 7,774,991 | B2 * | 8/2010 | Fletcher et al. | 52/71 |
| 2006/0174579 | A1 * | 8/2006 | Matson | 52/696 |
| 2006/0179734 | A1 * | 8/2006 | Fletcher et al. | 52/177 |

* cited by examiner

*Primary Examiner* — Basil Katcheves
*Assistant Examiner* — Beth Stephan
(74) *Attorney, Agent, or Firm* — Williams Mullen PC; Thomas F. Bergert

(57) ABSTRACT

A portable flooring system has one or more edge attachment members which can be used to quickly connect and secure panels or slats of the flooring system for deployment, installation and use, in one embodiment, the edge attachment elements are ultrasonically welded or otherwise permanently affixed to the flooring panels.

15 Claims, 4 Drawing Sheets

EDGE ATTACHMENT FOR PORTABLE GROUND FLOORING SYSTEMS

REFERENCE TO RELATED APPLICATIONS

This application claims the benefit of U.S. provisional patent application Ser. No. 61/442,950, filed Feb. 15, 2011 and entitled "Edge Attachments for Portable Ground Flooring Systems", the disclosure of which is incorporated herein by reference.

FIELD OF THE INVENTION

The present invention relates to portable ground flooring systems, and more particularly to portable ground flooring systems having specially adapted edge attachment members to assist in assembly, installation and use.

BACKGROUND

Unmodified ground surfaces hinder the ability to set up quick, stable, level and secure environments for a variety of purposes. For example, outdoor field events such as carnivals, corporate outings, wine tastings, mountain bike races and even military deployments often require booths, tents or other structures with solid and stable flooring from which to manage the event. Particularly if computers or other equipment typically found in an indoor workplace environment are required, it becomes almost essential to provide a more stable, strong, level and secure ground flooring capable of rapid deployment and disassembly.

Recently, flooring systems and methods have been developed that minimize necessary storage space when not in use or when being transported and minimize pack-up time and effort, while also maintaining sufficient overall strength. Such flooring systems can be adapted to various shapes of ground surfaces and wet environments, including uneven ground. Such flooring systems are described, for example, in our U.S. Pat. Nos. 7,090,430; 7,364,383 and 7,774,991, which are incorporated by reference herein in their entireties. U.S. Pat. No. 7,090,430 shows, in FIG. 7, adjacent edges of separate floor slats or panels being attached using hook and loop type fasteners. However, in many cases, hook and loop connectors and extra seam cap members are not desirable. Accordingly, the present invention is directed to resolving these and other issues with portable ground flooring systems.

SUMMARY OF THE PRESENT INVENTION

The present invention provides portable ground flooring system edge attachment members which can be used to quickly connect and secure panels or slats of a flooring system for deployment, while improving the ability to quickly disassemble and stack the flooring. In one embodiment, the slats or panels can be formed of high-impact plastic which largely conforms to non-level, rolling ground while maintaining bridging strength for ground discontinuities.

The slats can be secured in a series, and a series of slats can be secured in multiple rows to create a solid, manipulable floor readily deployable on ground areas of virtually any shape and wetness characteristics.

The edge attachment member(s) of the present invention can be used to secure the multiple slats or panels edge-to-edge without requiring external or peripheral items. In one embodiment, each edge attachment member is made of thermo-formed and co-extruded plastic material or other solid material suitable for the purposes of the present invention. In one embodiment of the present invention, the edge attachment members are secured to the panels or slats through ultrasonic welding. In other embodiments of the present invention, the edge attachment members can be secured to the slats through solvent welding, glue, stapling and other means.

DETAILED DESCRIPTION OF THE INVENTION

Figure 1:
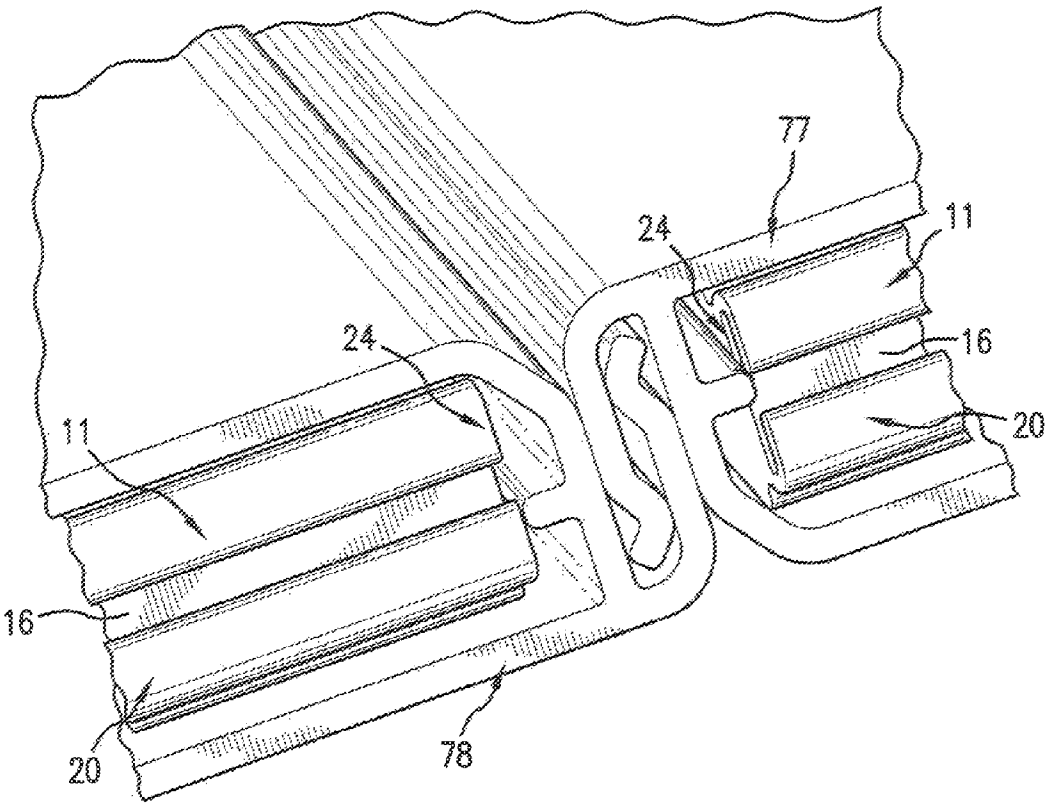
FIG. 1 is a photograph showing a front perspective view of one embodiment of the present invention.
Figure 2:
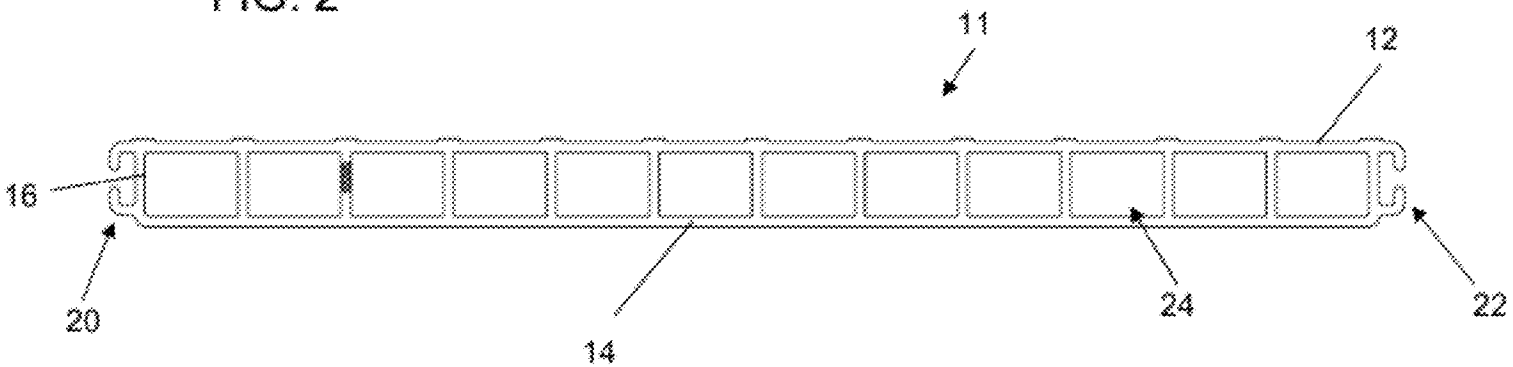
FIG. 2 is a font elevation view of the edge of a panel member for use with the present invention.

FIG. 1 shows a front perspective view of two flooring slats employing two edge attachment members 77, 78 according to one embodiment of the present invention. As shown in FIG. 1, flooring panels 11 having side walls 16 and connector members 20 are sleeved by edge attachment members 77, 78, FIG. 2 shows a front elevational view of a single panel with top 12, bottom 14 and C-shaped connector members 20, 22 on the sides. The individual connector members 20, 22 can be provided in various shapes, forms and sizes, and function to secure the panel members in a side wall-to-side wall fashion, two at a time. In one embodiment, the connector members bring adjacent panels into a tight adjacent fit to give the semblance of a permanent seam, which thereby prevents "punch through" of loads which may be borne directly on a given seam. The edge attachment members of the present invention do not cover these connector members 20, 22, but rather attach over the sides of the panels where there is no connector member.

In one embodiment of the present invention, the panels are approximately ½ to two inches in height and five to seven feet in length, but other sizes can be produced depending upon the particular implementation involved. The invention is not dimensionally constrained. Further, while FIGS. 1 and 2 show flooring panels with a substantially rectangular shape, it will be appreciated that the present invention can be adapted to suit other shapes as desired, including without limitation, circular, polygonal or other shapes.

Figure 4:
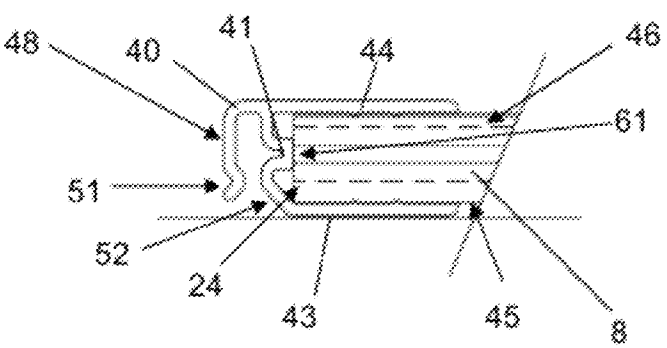
FIG. 4 is a partial cross-sectional view of one panel member with an edge attachment member installed at the panel edge, in accordance with the present invention.
Figure 3:
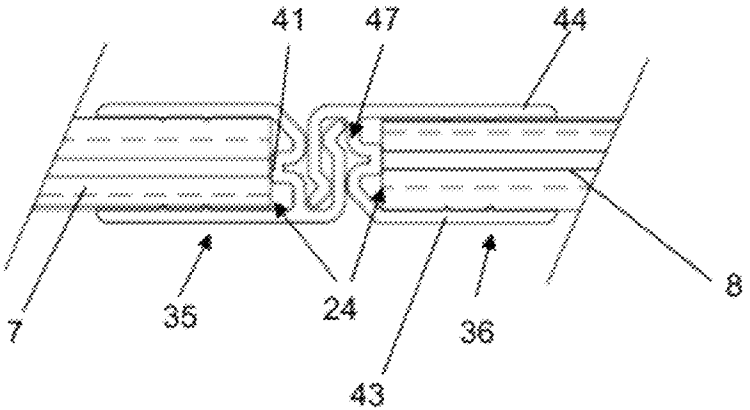
FIG. 3 is a partial cross-sectional view of two panel members connected edge to edge by interlocking edge attachment members, in accordance with the present invention.
Figure 7:
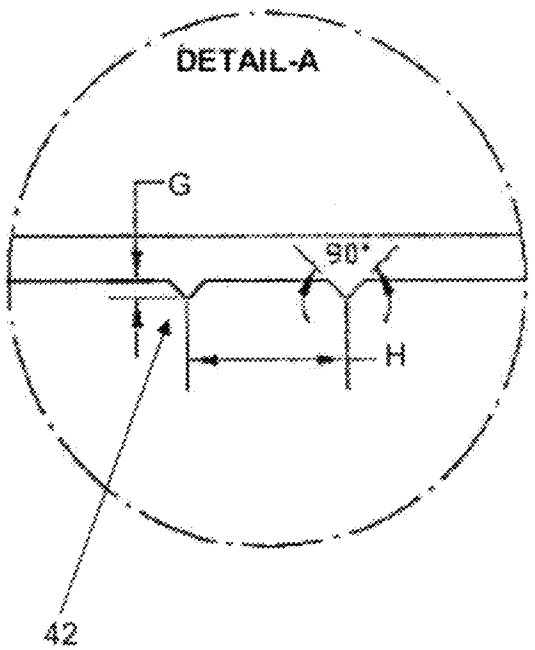
FIGS. 6 and 7 are detailed front elevation views of an edge attachment member in accordance with the present invention.
Figure 6:
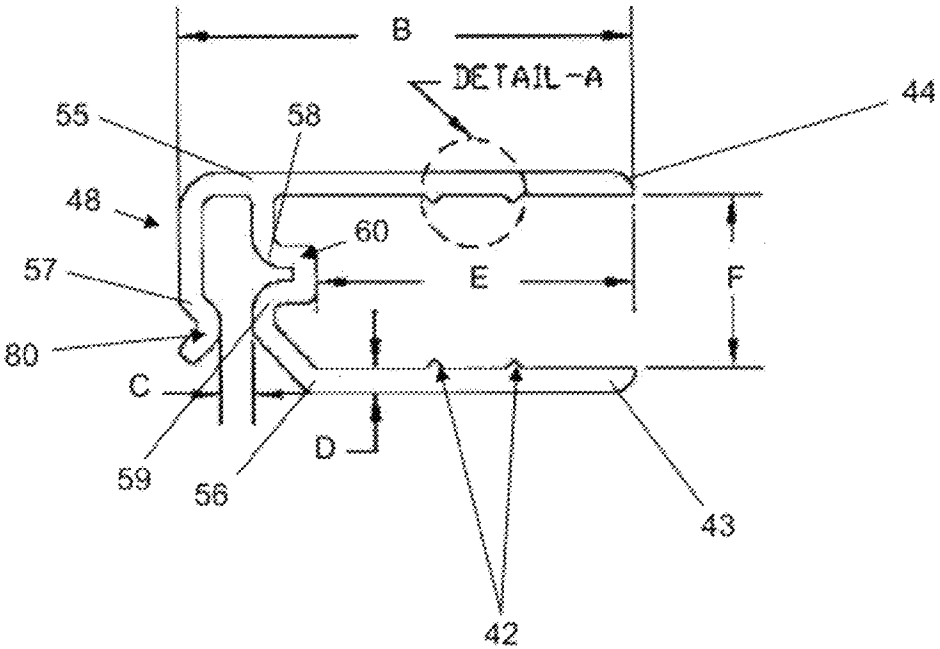

As shown in FIGS. 1 and 2, for example, the panel members 11 have edges 24 which can be joined with other edges to expand the flooring as necessary for a particular application. As shown in FIGS. 3 and 4, for example, panel members 7 and 8 can be secured at respective edges 24 using interlocking edge attachment members 35 and 36. Each edge attachment member 35, 36 is a single piece and can be characterized as a plurality of segments. The interlocking edge attachment members can be welded onto the respective edges 24, such that a first sleeve segment 44 of the edge attachment 36 runs parallel to and is flush with the top surface 46 of the floor panel member 8 and a second sleeve segment 43 of the edge attachment 36 runs parallel to and is flush with the bottom surface 45 of the floor panel member 8. In one embodiment of the present invention, as shown in FIGS. 6 and 7, at least one prong 42 extends perpendicularly from sleeve segments 43 and 44. These prongs 42 are energy concentrators for the embodiment of the present invention where the edge attachment members are welded to the slats.

As shown in FIGS. 3-4 and 6, for example, the first sleeve segment 44 and the second sleeve segment 43 are connected by a connector segment 47. The connector segment 47 comprises a first connector segment endpoint 55, a second connector segment endpoint 56 and a clip support member 41. The clip support member 41 extends substantially perpendicularly from the middle of the connector segment 47 that connects the two substantially parallel sleeve segments 43 and 44. In one embodiment, as shown in FIG. 6, the clip support member 41 comprises a first clip support member endpoint 58, a second support member endpoint 59 and a mid-segment 60 that is substantially U-shaped, wherein the two clip support member endpoints 58 and 59 are positioned at the top of the U, and wherein the U-shaped mid-segment extends from the connector segment 47 into the area between the first sleeve segment 44 and the second sleeve segment 43, and in substantially parallel relation therewith. In one embodiment, as shown in FIG. 4, each edge attachment member is inserted onto the floor panel member 8 such that the bottom surface 61 of the U-shaped mid-segment 60 of the clip support member 41 is flush with the edge 24 of the floor panel member 8.

In one embodiment of the present invention, a bottom portion 52 of the connector segment 47 is angled towards the panel member edge 24 that the edge attachment member 36 is installed on, as shown in FIG. 4. The bottom portion 52 is the segment between the second clip support member endpoint 59 and the second connector segment endpoint 56. In the embodiment of the present invention where the connector segment 47 includes an angled or curved bottom portion 52, the first sleeve segment 44 of the edge attachment is slightly longer in length than the second sleeve segment 43. It will be appreciated that the lower half of the connector segment in the embodiment of the present invention shown in FIGS. 3 and 4 is not a mirror image of the top half of the connector segment 47.

In one embodiment, as shown in FIGS. 3-4 and 6, each edge attachment member further includes a substantially L-shaped extension arm 48 extending substantially horizontally from first sleeve segment 44 at or near the first connector segment endpoint 55. Extension arm 48 has a substantially 90-degree curve formed at edge 40 that results in a downward extending portion 57, with a curved clip pinching element 51 at the base of the downward extending portion 57. The mid-portion 80 of the clip pinching element 51 indents inwardly of the downward extending portion 57 towards the connector segment 47.

As shown in FIG. 3, edge attachment member 35 can be installed onto the edge 24 of the floor panel member 7 in a similar manner; however, the edge attachment member is arranged in reverse orientation to that of member 36 in order to interlock therewith. In this way, the rows of panel members can be tightly secured edge-to-edge.

Figure 5:
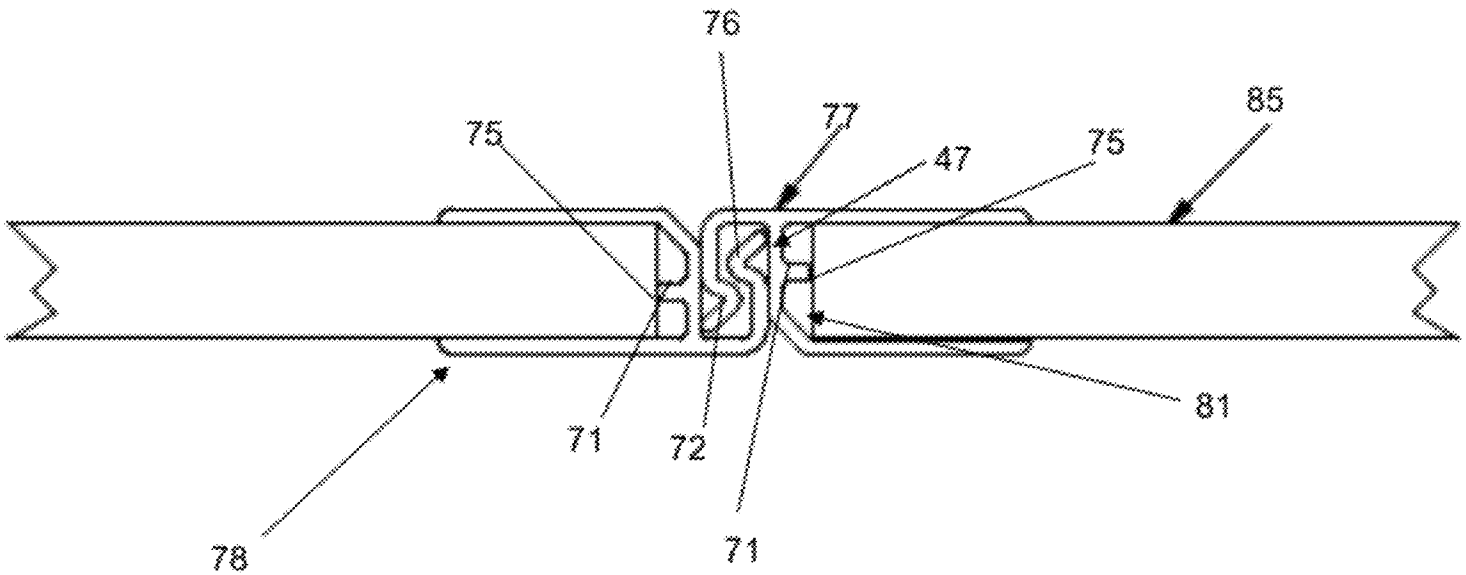
FIG. 5 is a partial cross-section view of two panel Members connected edge to edge by edge attachment members in accordance with one embodiment of the present invention.

As shown in FIG. 5, the clip support member 71 and clip pinching element 72 can take a different form to that shown in FIGS. 3 and 4. For example, the clip support member 71 can extend substantially perpendicularly from the connector segment 47 into the area between the first sleeve segment 44 and the second sleeve segment 43. In this embodiment, the edge attachment member 77 is inserted onto the floor panel member 85 such that the tip 75 of the clip support member 71 is flush with the edge 81 of the floor panel member 85. Further, as shown in FIG. 5, the mid-portion 76 of the clip pinching element 72 extends further inward toward the connector segment 47 to provide greater surface area contact with the opposing clip pinching element when installed. FIG. 1 also shows this alternative embodiment of the present invention.

It will be appreciated that the shapes and spatial relationships of the sleeve segments, clip support, connector segment and clip pinching element are substantially as shown in the drawings in order to meet the requirements for a tight fitting engagement with the ability to flex and give so that the edge attachments can be joined and separated at will. Representative dimensions in FIGS. 6 and 7 can be as follows in accordance with one embodiment of the present invention: distance B can be approximately between 1.4 and 1.5 inches inclusive; distance C can be approximately between 1.4 and 1.5 inches inclusive; distance B can be approximately between 1.4 and 1.5 inches inclusive; distance C can be approximately 0.1 inches; distance D can be approximately between 0.6 and 0.8 inches inclusive; distance E can be approximately between 0.95 and 1.05 inches inclusive; distance F can be approximately between 0.50 and 0.55 inches inclusive; distance G can be approximately between 0.020 and 0.030 inches inclusive; and distance H can be approximately between 0.20 and 0.30 inches inclusive. Further, as shown in FIG. 6, the prong 42 can extend from the surface of the sleeve members at an angle of 45 degrees on both sides, thereby comprising a substantially 90 degree angle.

The invention may be embodied in other specific forms without departing from the spirit or essential characteristics thereof. The present embodiments are therefore to be considered in all respects as illustrative and not restrictive, the scope of the invention being indicated by the claims of the application rather than by the foregoing description, and all changes which come within the meaning and range of equivalency of the claims are therefore intended to be embraced therein.

The invention claimed is:

1. A flooring edge attachment member, comprising:

a first sleeve segment;

a second sleeve segment, wherein the second sleeve segment runs substantially parallel to the first sleeve segment and forms an open area between the first sleeve segment and the second sleeve segment;

a connector segment having a first connector segment endpoint and a second connector segment endpoint, wherein the connector segment is integrally formed with and connects the first sleeve segment to the second sleeve segment, and further wherein the connector segment includes a clip support member extending therefrom; and an extension arm extending substantially horizontally from the first sleeve segment at or near the first connector segment endpoint in a direction opposite the direction the clip support member extends, wherein the extension arm comprises a curved edge and a clip pinching element, wherein the clip pinching element includes a mid-portion extending towards the connector segment.

2. The edge attachment member of claim 1, further comprising at least one prong that extends substantially perpendicularly from the first sleeve segment.

3. The edge attachment member of claim 1, further comprising at least one prong that extends substantially perpendicularly from the first and second sleeve segments.

4. The member of claim 1, wherein the clip support member comprises:

a first clip support member endpoint;

a second clip support member endpoint; and a clip support member mid-segment, wherein the clip support member mid-segment extends into the area between the first sleeve segment and the second sleeve segment.

5. The edge attachment member of claim 4, wherein the connector segment further comprises a bottom portion between the second clip support member endpoint and the second connector segment endpoint, wherein the bottom portion is angled inward and away from the extension arm.

6. The edge attachment member of claim 4, wherein the clip support member mid-segment is substantially U-shaped.

7. The edge attachment member of claim 4, wherein the second clip support member endpoint comprises a curved edge.

8. The edge attachment member of claim 1, wherein the clip support member extends substantially perpendicularly into the area between the first sleeve segment and the second sleeve segment.

9. A flooring edge attachment member, comprising:

a first sleeve segment;

a second sleeve segment, wherein the second sleeve segment runs substantially parallel to the first sleeve segment and forms an open area between the first sleeve segment and the second sleeve segment;

a connector segment having a first connector segment endpoint and a second connector segment endpoint, wherein the connector segment is integrally formed with and connects the first sleeve segment to the second sleeve segment; and an extension arm, wherein the extension arm extends substantially horizontally from the first sleeve segment at or near the first connector segment endpoint, wherein the extension arm has an edge and a downward extending portion extending substantially at a 90-degree angle from the edge, wherein the downward extending portion has a base and wherein the extension arm further includes a curved clip pinching element at the base of the downward extending portion, and wherein the clip pinching element includes a mid-portion that indents inwardly of the downward extending portion towards the connector segment.

10. The member of claim 9 wherein the connector segment further includes a clip support member extending therefrom.

11. The member of claim 10, wherein the clip support member comprises:

a first clip support member endpoint;

a second clip support member endpoint; and a clip support member mid-segment, wherein the clip support member mid-segment extends into the area between the first sleeve segment and the second sleeve segment.

12. The member of claim 11, wherein the clip support member mid-segment is substantially U-shaped.

13. The member of claim 10, wherein the clip support member extends substantially perpendicularly into the area between the first sleeve segment and the second sleeve segment.

14. A flooring edge attachment member, comprising:

a first sleeve segment;

a second sleeve segment, wherein the second sleeve segment runs substantially parallel to the first sleeve segment and forms an open area between the first sleeve segment and the second sleeve segment;

a connector segment having a first connector segment endpoint and a second connector segment endpoint, wherein the connector segment is integrally formed with and connects the first sleeve segment to the second sleeve segment, and further wherein the connector segment includes a clip support member extending therefrom, wherein the clip support member includes a substantially U-shaped mid-segment that extends into the area between the first sleeve segment and the second sleeve segment; and an extension arm extending substantially horizontally from the first sleeve segment at or near the first connector segment endpoint in a direction opposite the direction the clip support member extends.

15. A flooring edge attachment member, comprising:

a first sleeve segment;

a second sleeve segment, wherein the second sleeve segment runs substantially parallel to the first sleeve segment and forms an open area between the first sleeve segment and the second sleeve segment;

a connector segment having a first connector segment endpoint, a second connector segment endpoint and a bottom portion, wherein the connector segment is integrally formed with and connects the first sleeve segment to the second sleeve segment, wherein the connector segment includes a clip support member extending therefrom, and further wherein the connector segment bottom portion is angled inward and toward the second sleeve segment; and an extension arm extending substantially horizontally from the first sleeve segment at or near the first connector segment endpoint in a direction opposite the direction the clip support member extends.

* * * * *